United States Patent [19]

Raymond, Jr.

[11] Patent Number: 4,678,414

[45] Date of Patent: Jul. 7, 1987

[54] PERISTALTIC DIAPHRAGM PUMP WITH CONICALLY SHAPED NUTATING MEMBERS

[76] Inventor: Charles Raymond, Jr., 312 Sixth St., Petaluma, Calif. 94952

[21] Appl. No.: 938,833

[22] Filed: Dec. 8, 1986

[51] Int. Cl.[4] ..... F01C 5/00

[52] U.S. Cl. ..... 418/45; 418/153

[58] Field of Search ..... 417/474; 418/45, 153

[56] References Cited

U.S. PATENT DOCUMENTS

| | | | |
|---|---|---|---|
| 2,249,806 | 7/1941 | Bogoslowsky | 418/45 |
| 3,058,428 | 10/1962 | Gemeinhardt | 418/45 |
| 4,371,321 | 2/1983 | Koblo et al. | 417/474 X |

*Primary Examiner*—Carlton R. Croyle

*Assistant Examiner*—Eugene L. Szczecina, Jr.

*Attorney, Agent, or Firm*—Flehr, Hohbach, Test, Albritton & Herbert

[57] ABSTRACT

A peristaltic diaphragm pump comprises a drive shaft, two nutating members having inner surfaces and a flexible tubular member wound at least 360° around the axis of rotation defined by the drive shaft such that the nutating members nutate to peristaltically compress the tubular member between the inner surfaces and to provide a continuous linear sealing as the drive shaft is rotated. Each of the inner surfaces is shaped like a truncated cone with the slope in the radial direction linearly changing around its axis and a shaft therethrough is affixed obliquely so as to wobble with respect to the drive shaft.

7 Claims, 3 Drawing Figures

PERISTALTIC DIAPHRAGM PUMP WITH CONICALLY SHAPED NUTATING MEMBERS

BACKGROUND OF THE INVENTION

This invention relates to a peristaltic diaphragm pump and more particularly to such a peristaltic diaphragm pump having nutating members which act upon a tubular diaphragm to provide a continuous sealing and flow of fluid.

Peristaltic diaphragm pumps and their advantages over pumps of the ordinary kind with a cylinder and a piston have been described, for example, in U.S. Pat. Nos. 3,058,428, 3,669,578, 3,922,119 and 4,483,666. Prior art peristaltic diaphragm pumps disclosed in these patents generally comprise a tubular member which spirals radially in the form of a nearly complete circle sandwiched between a stationary surface and a nutating surface so as to be peristaltically compressed therebetween along a radial sealing line. Since the tubular member through which a liquid is pumped does not form a complete circle, however, there is a loss of internal pressure every time the radial sealing line passes the direction in which the circle is not complete. Another disadvantage of prior art pumps of this type relates to their inability to handle foreign matter in the fluid without damage to the diaphragm or loss of pressure therein.

SUMMARY OF THE INVENTION

It is therefore an object of the present invention to provide a peristaltic diaphragm pump which can provide a continuous fluid flow.

It is another object of the present invention to provide a peristaltic diaphragm pump with reduced leakage problems and continuous sealing.

It is a further object of the present invention to provide a peristaltic diaphragm pump which can handle foreign matter in fluid without damage to the diaphragm or loss of internal pressure.

The above and other objects of the present invention are achieved by providing a peristaltic diaphragm pump comprising a drive shaft defining an axis of rotation and a flexible tubular member wound radially around this axis of rotation between two nutating members which are adapted to execute nutational motion to peristaltically compress and to provide a continuous linear sealing to the tubular member between their inner contact surfaces. Each of these contact surfaces is shaped like a cone with linearly changing slope with respect to a shaft which is obliquely affixed to the drive shaft so as to wobble when the drive shaft is rotated around its axis of rotation.

BRIEF DESCRIPTION OF THE DRAWINGS

The accompanying drawings, which are incorporated in and form a part of the specification, illustrate one embodiment of the present invention, and together with the description, serve to explain the principles of the invention. In the drawings.

DETAILED DESCRIPTION OF THE INVENTION

Figure 1:
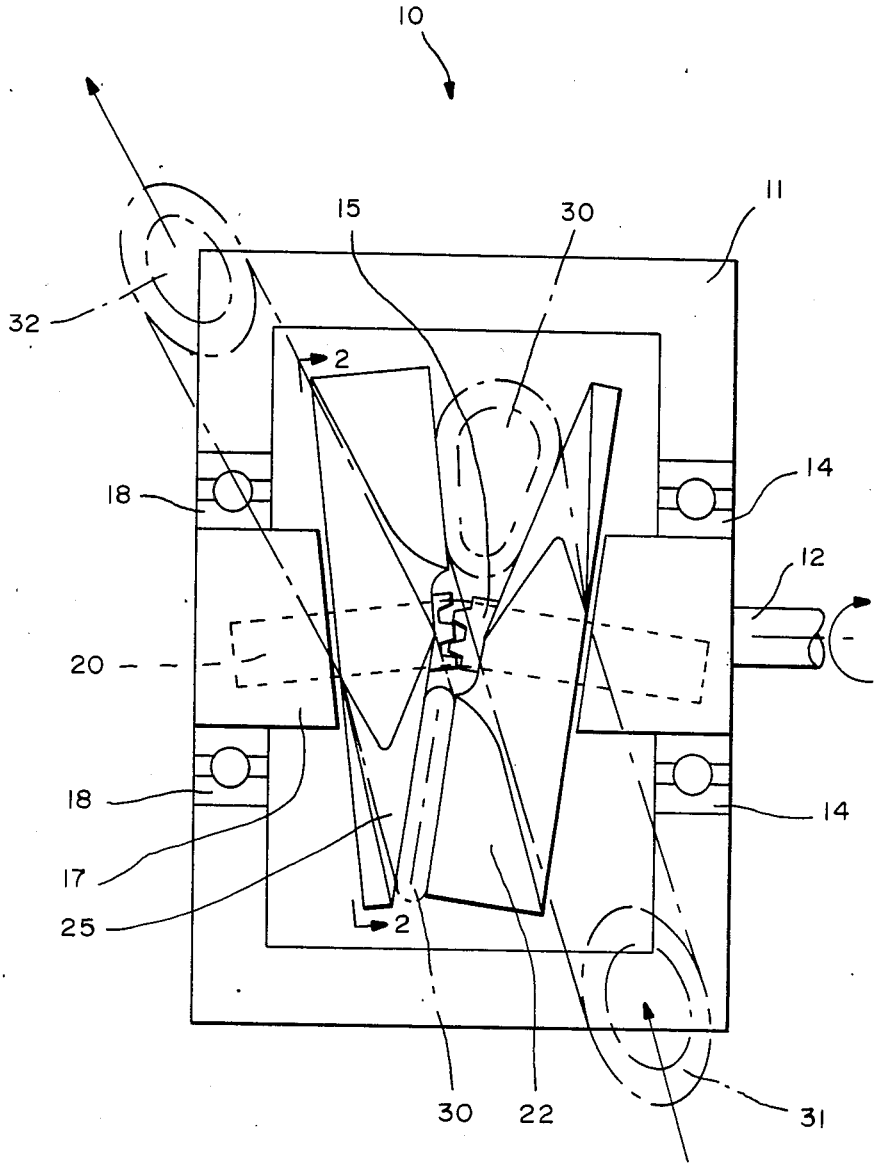
FIG. 1 is a sectional view of a peristaltic diaphragm pump embodying the present invention.
Figure 2:
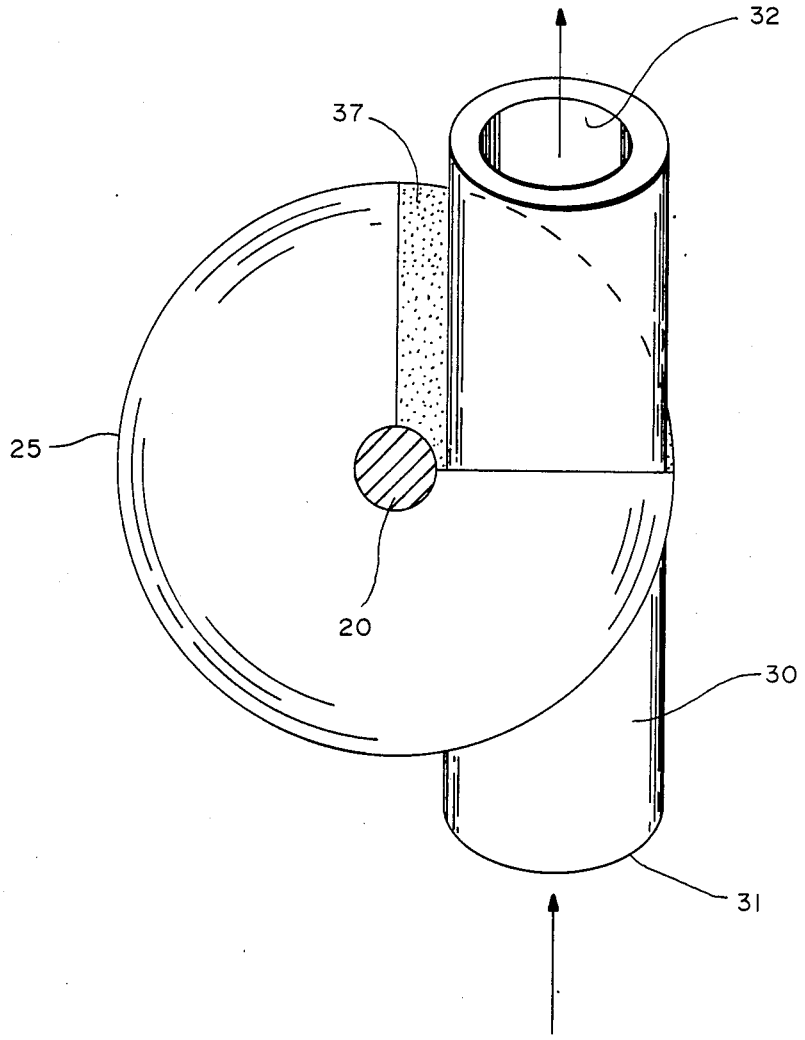
FIG. 2 is a view taken along the line 2—2 of FIG. 1.

FIGS. 1 and 2 illustrate a peristaltic diaphragm pump 10 embodying a preferred embodiment of the present invention. The pump 10 comprises a generally cylindrical housing 11 which coaxially supports a drive shaft. A bearing 14 is mounted between the housing 11 and the drive shaft 12 to permit the drive shaft 12 to freely rotate around its axis. A first oblique shaft 15 is firmly affixed to the drive shaft 12 at an eccentric position with the other end positioned approximately on the axis of rotation of the drive shaft 12. A follower shaft 17 is likewise rotatably supported by the housing 11 on the surface opposite to and in a coaxial relationship with the drive shaft 12. Another bearing 18 is mounted between the follower shaft 17 and the housing 11. A second oblique shaft 20 is firmly affixed to the follower shaft 17 at an eccentric position similarly to the first oblique shaft 15 with respect to the drive shaft 12. Thus, the other end of the second oblique shaft 20 is also approximately on the axis of rotation of the drive shaft 12 and the follower shaft 17, and connected with the first oblique shaft 15 in a rotary-motion-communicating relationship therewith such that the two oblique shafts 15 and 20 rotate at the same rate, maintaining, the same relative angular positional relationship to the axis of rotation of the drive and follower shafts. In the illustrated embodiment, each oblique shaft makes an angle of about 8° with respect to the aforementioned axis of rotation, but this angle is not intended to limit the scope of this invention.

A first truncated cone-shaped nutating member 22 is coaxially supported on the first oblique shaft 15, and a second nutating member 25 shaped identically to the first nutating member 22 is likewise coaxially supported on the second oblique shaft 20. The oblique shafts 15 and 20 are freely rotatable with respect to the nutating members 22 and 25 such that the nutating members 22 and 25 will nutate but not rotate as the drive shaft 12 is rotated around its axis of rotation, causing the oblique shafts 15 and 20 to wobble as explained above and to communicate the driving force from the drive shaft 12 to the follower shaft 17.

A tubular member 30 with an inlet 31 and an outlet 32 is wound more than 360° around the axis of rotation of the drive shaft 12 between the inner surfaces (that is, the surfaces which face opposite to each other) of the two nutating members 22 and 25. The external surface of the tubular member 30 is affixed to the inner surface of the nutating members 22 and 25 such that the tubular member 30 is peristaltically compressed along a radial sealing line as the rotation of the drive shaft 12 causes the members 22 and 25 to nutate but does not slide with respect to the inner surfaces of the nutating members 22 and 25 during this peristaltic compression. The tubular member 30 is preferably formed by a laminated, thick, flexible, elastomeric material such that the seal is maintained if solid foreign matter that may be carried by the fluid is caught inside the tubular member 30. When the inner surfaces of the nutating members 22 and 25 compress the tubular member 30, the elastomeric material deforms, and the radial sealing line passes over such entrapped foreign matter which will become released and then carried away by the next charge of fluid.

Figure 3:
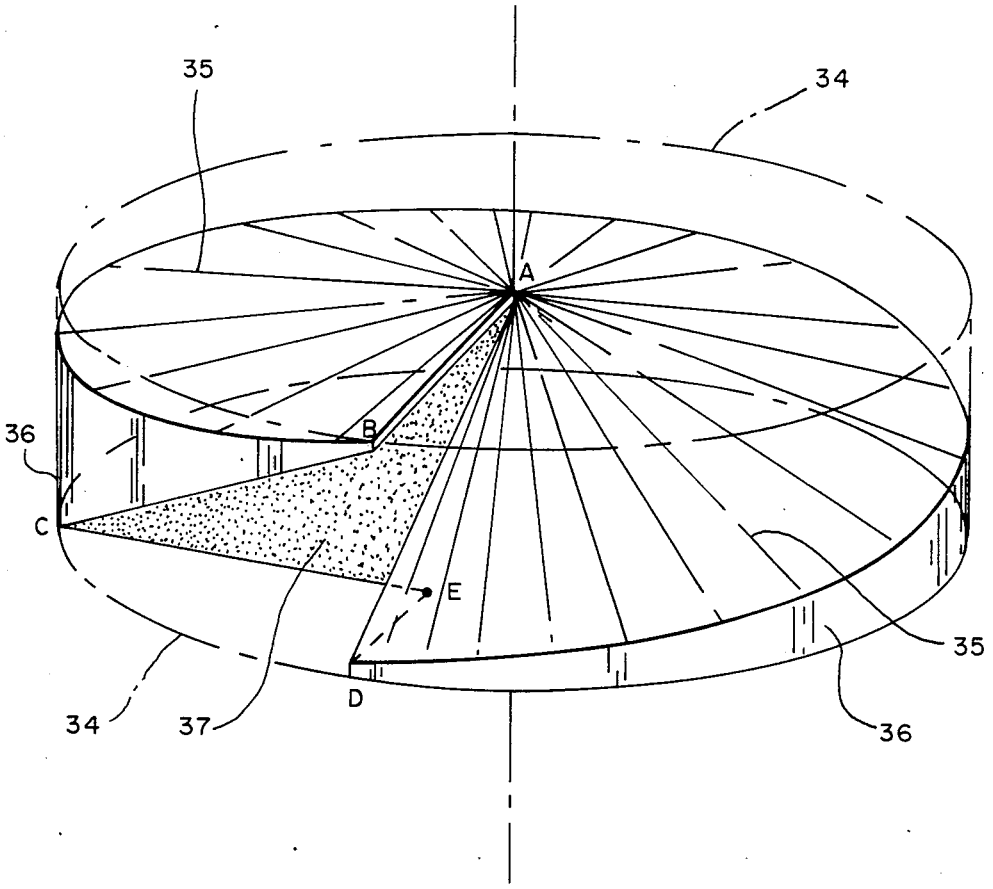
FIG. 3 is a perspective view of a geometrical figure for explaining the shape of the nutating members shown in FIG. 1.

The shape of each nutating member 22 or 25, briefly described above as truncated cone-shaped, will be explained next more in detail by way of FIG. 3. Consider a disk, or a cylinder outlined in part by phantom lines 34 in FIG. 3. A truncated cone-shaped surface shaded by diagonal lines 35 in FIG. 3 can be obtained from this disk by placing its apex at the center of the top surface of the disk (point A) and varying the slope of the radial line from the apex A along this cone-like surface linearly from AB to AD as the angle around the axis of symmetry of the original disk is increased. In FIG. 3, vertical shade lines 36 indicate the side surface of the original disk. The solid wedge-like sector of the disk emcompassed by the line A-B-C-D-E-A is removed to provide a channel 37 through which an end portion of the tubular member 30 leading to the inlet 31 or the outlet 32 is disposed, as shown more clearly in FIGS. 1 and 2. The axial hole through which an oblique shaft 15 or 20 penetrates the member is not shown in FIG. 3.

FIG. 3 has been drawn in an exaggerated manner in order to make it easier to understand the basic design of the nutating members 22 and 25. The maximum and minimum slopes of their cone-like surfaces are related to the angle between each oblique shaft 15 or 20 and the axis of rotation of the drive shaft 12 such that the inner surfaces of the nutating members 22 and 25 maintain secure linear sealing on the tubular member 30 along a radial line at all times as the oblique shafts 15 and 20 wobble around the axis of rotation of the drive shaft 12 and the nutating members execute nutational motions. In the illustrated embodiment, the maximum slope (made by radial line AD) is about 16° and the minimum slope (made by radial line AB) is about 0° (that is, perpendicular to the axis of symmetry of the disk) so that the angle BAD is about 16°, or equal to the angle between the oblique shafts 15 and 20.

Pumps embodying the present invention have many advantageous characteristics. In addition to advantages shared by some of prior art peristaltic diaphragm pumps such as good sealing along only one line contact and extremely low ratio of leak path to pumped volume, a pump of the present invention has the ability to provide a continuous flow without a loss of pressure between cycles because the tubular member is wound spirally by more than 360 degrees so as to provide a continuous sealing. According to the present invention, furthermore, the tubular member comprises a thick flexible elastomeric material such that the pump can handle foreign matters in the fluid without damage to the diaphragm or loss of internal pressure.

The foregoing description of a preferred embodiment of the invention has been presented for purposes of illustration and description. It is not intended to be exhaustive or to limit the invention to the precise form disclosed, and many modifications and variations are possible in light of the above teaching. For example, FIGS. 1 and 2 are not intended to represent the preferred dimensional relationship of various components. The two oblique shafts 15 and 20 are shown in FIG. 1 to be in rotary-motion-communicating relationship with respect to each other by means of bevel gears but this motion-communicating mechanism is not intended to limit the scope of this invention. In addition, the tubular member 30 need not be rigidly attached to both nutating members. In order to prevent the tubular member from sliding, it is sufficient if the tubular member is affixed to one of the truncated cone-like surfaces sandwiching it therebetween. In summary, such modifications and variations which may be apparent to a person skilled in the art are intended to be included within the scope of this invention.

What is claimed is:

1. A peristaltic diaphragm pump comprising a drive shaft defining an axis of rotation, a first nutating member having a first contact surface, a second nutating member having a second contact surface, means for mounting said first and second members for nutating movement with respect to said axis of rotation and with said contact surfaces in mutually facing relationship, and a flexible tubular member having an inlet and an outlet at ends thereof, said tubular member disposed between said first and second contact surfaces and around said axis of rotation, each of said contact surfaces being nearly conical with the slope linearly changing from a minimum angle to a maximum angle around an oblique axis with respect to said axis of rotation such that each of said nutating members nutates with respect to said axis of rotation to compress said tubular member peristaltically between said contact surfaces and to provide a linear radial sealing on said tubular member as said drive shaft is rotated around said axis of rotation.

2. The pump of claim 1 further comprising a first oblique shaft which is obliquely affixed to said drive shaft so as to wobble with respect to said axis of rotation when said drive shaft is rotated around said axis of rotation and a second oblique shaft which is in a rotary-motion-communicating relationship with said first oblique shaft and is adapted to wobble around said axis of rotation at the same time as said first oblique shaft when said drive shaft is rotated around said axis of rotation, said first and second oblique shafts respectively supporting said first and second nutating members rotatably therearound.

3. The pump of claim 2 wherein said first and second oblique shafts make an angle of about 16° therebetween.

4. The pump of claim 3 wherein said maximum angle is about 74° and said minimum angle is about 0°.

5. The pump of claim 1 wherein said tubular member is rigidly affixed to at least one of said contact surfaces so as to be prevented from sliding with respect thereto.

6. The pump of claim 1 wherein said tubular member comprises a laminated elastomeric material.

7. The pump of claim 1 wherein said tubular member is wound at least 360° around said axis of rotation such that said contact surfaces provide a continuous sealing as said drive shaft is rotated around said axis of rotation.

* * * * *